US008508322B2

(12) United States Patent
Yamada et al.

(10) Patent No.: US 8,508,322 B2
(45) Date of Patent: Aug. 13, 2013

(54) MAGNETIC ELEMENT

(75) Inventors: Yuichi Yamada, Tokyo (JP); Takayuki Yamaguchi, Tokyo (JP)

(73) Assignee: Sumida Corporation (JP)

( * ) Notice: Subject to any disclaimer, the term of this patent is extended or adjusted under 35 U.S.C. 154(b) by 0 days.

(21) Appl. No.: 13/147,033

(22) PCT Filed: Jan. 28, 2010

(86) PCT No.: PCT/JP2010/000492
§ 371 (c)(1),
(2), (4) Date: Jul. 29, 2011

(87) PCT Pub. No.: WO2010/089979
PCT Pub. Date: Aug. 12, 2010

(65) Prior Publication Data

US 2011/0291783 A1 Dec. 1, 2011

(30) Foreign Application Priority Data

Feb. 3, 2009 (JP) ..... 2009-022666

(51) Int. Cl.
*H01F 27/06* (2006.01)
*H01F 27/29* (2006.01)
*H01F 27/24* (2006.01)
*H01F 17/04* (2006.01)

(52) U.S. Cl.
USPC ..... 336/65; 336/192; 336/212; 336/221

(58) Field of Classification Search
USPC ..... 336/83, 192, 65, 182, 220, 221, 212, 336/198, 208
See application file for complete search history.

(56) References Cited

U.S. PATENT DOCUMENTS

| | | | | |
|---|---|---|---|---|
| 4,755,784 | A * | 7/1988 | Taoka et al. | 336/96 |
| 4,888,571 | A | 12/1989 | Kobayashi et al. | |
| 5,307,041 | A * | 4/1994 | Kato et al. | 336/83 |
| 5,751,203 | A * | 5/1998 | Tsutsumi et al. | 336/65 |
| 2008/0143466 | A1 * | 6/2008 | Monma | 336/83 |

FOREIGN PATENT DOCUMENTS

| | | |
|---|---|---|
| CN | 1117195 A | 2/1996 |
| DE | 4223097 A1 | 1/1993 |

(Continued)

OTHER PUBLICATIONS

International Search Report for International Application No. PCT/JP2010/000492 with English translation mailed May 11, 2010.

*Primary Examiner* — Mohamad Musleh
*Assistant Examiner* — Mangtin Lian
(74) *Attorney, Agent, or Firm* — Cantor Colburn LLP

(57) ABSTRACT

Disclosed is a magnetic element that makes it possible to prevent a coil terminal from being positioned on a ring mount. The magnetic element comprises a first core member, coils, which are disposed in a second core member and a bobbin, and a first mount, on which the first core member is mounted, and possesses a second mount, which is disposed rising up from, and positioned between both edges of, the first mount, and on which the second core member is mounted, and is further equipped with a base, with multiple terminals disposed protruding from the sides thereof. Furthermore, a protrusion is disposed at the edge of the second mount, extending in the direction moving away from said second mount, and this protrusion is smaller than the thickness dimension of the base, and a terminal is positioned on the back surface of the protrusion on the opposite side from the side on which the second core member is mounted, and then bound to the terminals.

3 Claims, 8 Drawing Sheets

(56) References Cited

FOREIGN PATENT DOCUMENTS

| | | | |
|---|---|---|---|
| JP | H01163306 | U | 11/1989 |
| JP | 5-8914 | U | 2/1993 |
| JP | 10-303035 | A | 11/1998 |
| JP | 11-224819 | A | 8/1999 |
| JP | 2008-4740 | A | 1/2008 |
| KR | 96-008184 | B1 | 6/1996 |

* cited by examiner

MAGNETIC ELEMENT

This is a U.S. national stage application of International Application No. PCT/JP2010/000492, filed on 28 Jan. 2010. Priority under 35 U.S.C. 119(a) and 35 U.S.C. 365(b) is claimed from Japanese Application No. JP 2009-022666, filed 3 Feb. 2009, the disclosure of which is also incorporated herein by reference.

FIELD OF THE INVENTION

The present invention relates to a magnetic element to be used for various electronic devices.

BACKGROUND

Some of various magnetic elements include a drum core, a ring core, as well as a base made of a resin material and the like. Patent Document 1 discloses an example of such kind of magnetic element. In the meantime, FIG. 8 shows a perspective view of a magnetic element 100 of that kind (in the figure, a ring core is dismounted). The magnetic element 100 shown in the figure is a transformer, in which a coil end part 121 of a coil 120 is wound on each of two of a plurality of terminals 111 located at a nearer side as well as two of a plurality of terminals 111 located at a further side.

PRIOR ART DOCUMENT

Patent Document

Patent Document 1: JP-UM-H01-163306

SUMMARY OF INVENTION

Problem to be Solved

As shown in FIG. 8, when a coil end part 121 of a coil 120 is wound on a terminal 111, the coil end part 121 (a lead wire) of the coil 120 extends from part of a drum core 130 where the coil 120 is placed (hereafter, the part is deemed to be a bobbin 131), toward part of a base 110 where a ring core is installed (hereafter, the part is deemed to be a ring mount portion 112). If the ring core is installed onto the ring mount portion 112 under the condition described above, the coil end part 121 may be located at the ring mount portion 112 and/or the coil end part 121 may interfere with the ring core.

In a case where the coil end part 121 is located at the ring mount portion 112, the coil end part 121 is pinched between the ring core and the ring mount portion 112. Meanwhile, in a case where the coil end part 121 and the ring core interfere with each other, it becomes difficult to appropriately install the ring core onto the ring mount portion 112. In either case, the ring core cannot be located at a correct position since the ring core becomes tilted, unstable, and the like. In other words, it is necessary to install the ring core onto the ring mount portion 112 while preventing the coil end part 121 from being positioned on the ring mount portion 112 under the condition of a structure shown in FIG. 8. Therefore, the installation work under the condition requires additional man-hours, and namely the coil end part 121 interferes with the installation work of the ring core.

The present invention has been made in view of the above-mentioned problems, and an object thereof is to provide a magnetic element which can prevent the coil end part from being positioned on the ring mount portion.

Means to Solve the Problem

To achieve the object described above, a first aspect of the present invention is that; a magnetic element according to the present invention includes: a first core member having a bobbin; a second core member so placed as to face the first core member in a whole range around an outer circumference of the first core member; a coil placed by winding a lead wire and placed at the bobbin; and a base having a first mount portion for placing the first core member, a second mount portion for placing the second core member and being raised higher than the first mount portion and positioned between both end portions, and a plurality of terminals protruding from a side of the base; wherein the end portion of the second mount portion has a protrusion lengthening in a direction apart from the second mount portion, and the protrusion is sized smaller than the thickness of the base; and a coil end part of the coil is wound on the terminal after the coil end part of the coil is placed at a reverse surface of the protrusion opposite to a side for placing the second core member.

According to a structure described above, the coil end part is situated on the reverse surface of the protrusion, and therefore this arrangement of the structure makes it possible to prevent the coil end part from being positioned on the second mount portion. Accordingly, it is possible to prevent the coil end part from pinching between the second core member and the second mount portion, and this arrangement makes it possible to prevent the second core member from becoming tilted, unstable, and so on. As a result, the second core member can precisely be positioned. Furthermore, since it is possible to prevent the coil end part from being positioned on the second mount portion, installation of the second core member onto the second mount portion can be carried out easily, and therefore an increase in working man-hours can be suppressed.

In the invention described above, another aspect of the magnetic element according to the present invention is that; preferably the end of the second mount portion in the base should have a concave portion recessed in a direction toward the opposite side of the base, and the protrusion is provided in a state of covering over the concave portion from the side for placing the second core member.

According to a structure described above, the coil end part is placed into the concave portion. Furthermore, since the coil end part is situated at the reverse surface of the protrusion, a bend of the coil end part can be so positioned as to be closer toward a center side in a radial direction, in comparison with a case where the concave portion is not provided. Thus, it becomes possible effectively to prevent the coil end part from becoming an obstacle for placement of the second core member.

Another aspect of the magnetic element according to the present invention is that; preferably the first core member is provided with a locating protrusion protruding in a direction toward a side of the base, while the first mount portion of the base is provided with an recessed portion into which the locating protrusion fits.

According to a structure described above, as the locating protrusion fits into the recessed portion, the first core member is positioned with respect to the base. Thus, the first core member can be precisely positioned with respect to the base so that the magnetic element is able to have stable characteristics.

Another aspect of the magnetic element according to the present invention is that; preferably the second core member should have a clearance portion where an inner diameter of an open portion of the second core member at a lower side for placing the second core member onto the second mount portion is formed to be larger in comparison with an inner diameter of the open portion at a upper side.

According to a structure described above, the coil end part can be easily led into the concave portion from the bobbin through the clearance portion. Therefore, the coil end part can be easily wound on the terminal while being positioned with the protrusion at the concave portion.

Advantageous Effect of the Invention

According to the present invention, it is possible to prevent a lead wire from being positioned on a ring mount portion.

DESCRIPTION OF THE PREFERRED EMBODIMENT

A magnetic element 10 according to an embodiment of the present invention is described below with reference to FIG. 1 through FIG. 7.

Figure 1:
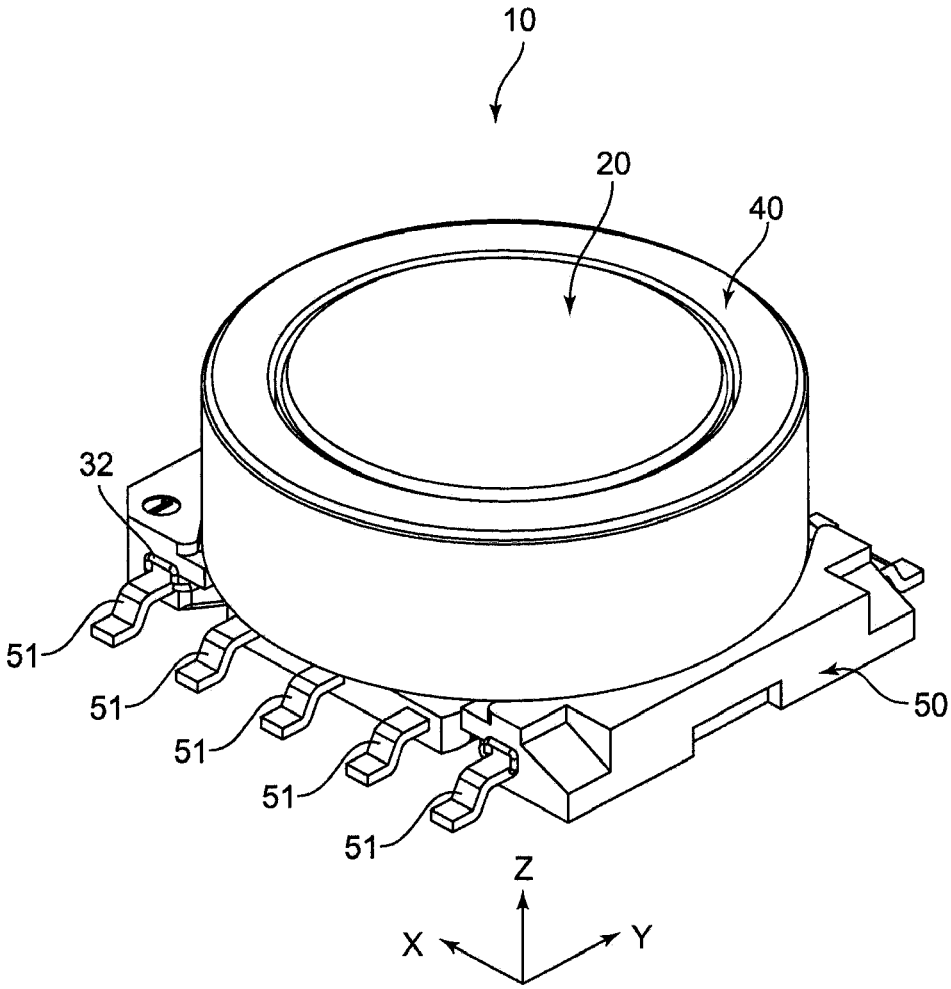
FIG. 1 is a perspective view showing a structure of a magnetic element according to an embodiment of the present invention.
Figure 2:
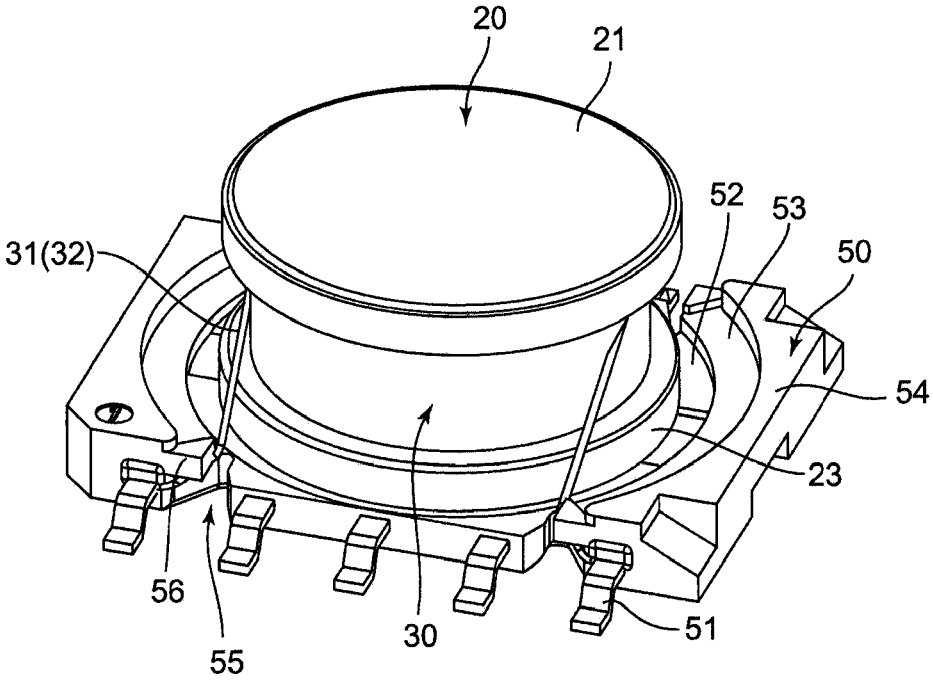
FIG. 2 is a perspective view showing a structure of a section, excluding a ring core, of the magnetic element of FIG. 1.
Figure 3:
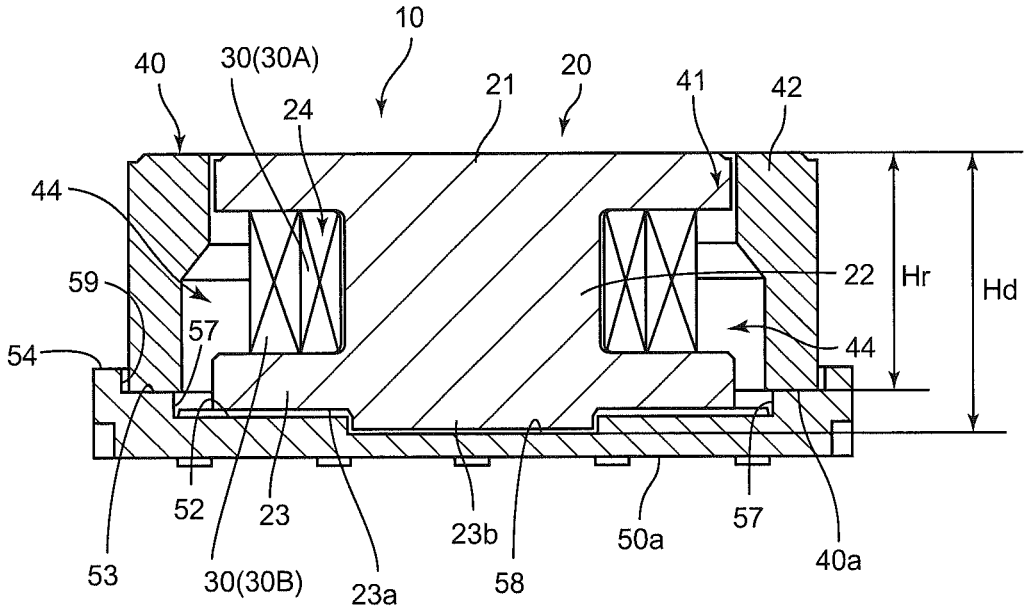
FIG. 3 is a cross sectional view of the magnetic element of FIG. 1, taken along an X-Z plane passing through a center of a drum core.
Figure 4:
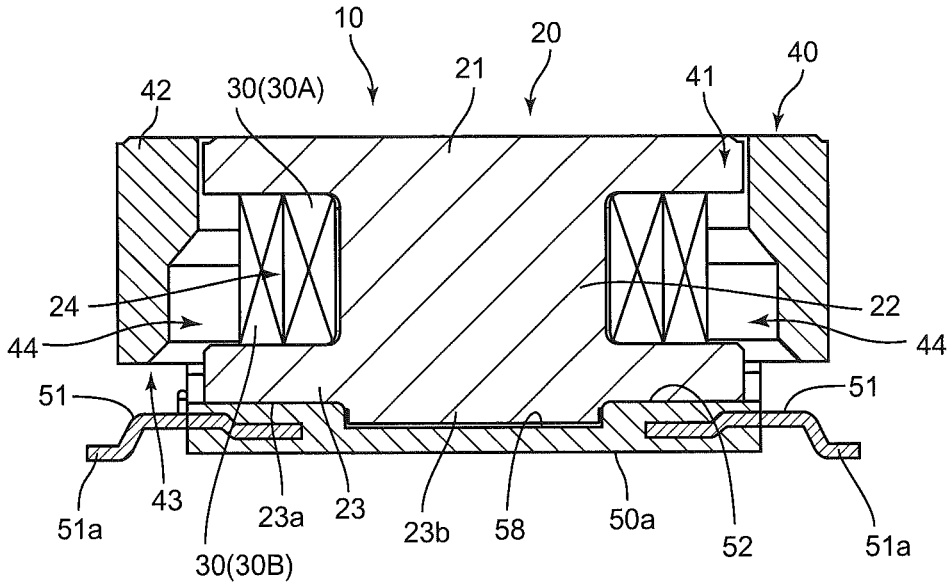
FIG. 4 is another cross sectional view of the magnetic element of FIG. 1, taken along an Y-Z plane passing through a center of a drum core.

As shown in FIG. 1 and so on, the magnetic element 10 according to the present embodiment is a transformer, and it includes a drum core 20, a coil 30, a ring core 40, and a base 50. The drum core 20 of these components corresponds to a first core member. As shown in FIG. 2 through FIG. 4, the drum core 20 includes an upper flange portion 21, a column portion 22, and a lower flange portion 23. Each of the upper flange portion 21, the column portion 22, and the lower flange portion 23 is provided so as to be circular in its plane view. In the present embodiment, the upper flange portion 21 of the drum core 20 is provided so as to have the same diameter as the lower flange portion 23. Moreover, in the present embodiment, the upper flange portion 21 and the lower flange portion 23 have the comparably-sized thickness in their dimensions.

In the drum core 20, an area surrounded by the upper flange portion 21, the column portion 22, and the lower flange portion 23 works as a bobbin 24 (Refer to FIG. 3 and FIG. 4); and a coil 30 can be formed by winding a lead wire 31 there. Moreover, since the magnetic element 10 in the present embodiment is a transformer, a primary coil 30A (an inner side of the coil 30) and a secondary coil 30B (an outer side of the coil 30) are wound on the bobbin 24, as shown in FIG. 3 and FIG. 4. In the following explanation, the two coil sections are simply referred to collectively as the coil 30, in a case where it is not needed to distinguish the primary coil 30A from the secondary coil 30B.

In the present embodiment, a locating protrusion 23*b* protrudes downward from a side of a bottom surface 23*a* of the lower flange portion 23, as shown in FIG. 3, FIG. 4, and so on. The locating protrusion 23*b* fits into a recessed portion 58 of the base 50 to be described later, and the drum core 20 is with respect to the base 50. Thus, the drum core 20 can be precisely located with respect to the base 50, and therefore the magnetic element 10 can have stable characteristics.

In the meantime, the ring core 40 corresponds to a second core member. As shown in FIG. 1, FIG. 3, FIG. 4, and so on, the ring core 40 is a core member so formed as to be seen as a circular ring in its overhead view, and it is possible for the drum core 20 described above to be situated at an open portion 41 of the ring core 40. As shown in FIG. 4, the height 'Hr' of the ring core 40 is provided to be shorter than the height 'Hd' of the drum core 20. Alternatively, the height 'Hr' may be larger than the height 'Hd', or their heights may be even the same.

With regard to the open portion 41, a dimension in a radial direction at a lower side is provided to be larger than that at an upper side, as shown in cross-sectional views of FIG. 3 and FIG. 4. In other words, there is a clearance portion 44 formed in the ring core 40; wherein a dimension of a core part 42 in a radial direction becomes smaller as an elevation shifts downward from a halfway position in a height direction, and the dimension becomes constant in a range from a certain position to a bottom end. Owing to the clearance portion 44, a coil end part 32 of the coil 30 is easily led to a concave portion 55, to be described later, from the bobbin 24 through the clearance portion 44. Therefore, the coil end part 32 of the coil 30 is easily wound on a terminal 51, while being located at a protrusion 56 of the concave portion 55, to be described later.

A cutout portion 43 is provided upwardly from a downward direction in the ring core 40. The cutout portion 43 is a portion provided for pulling out the coil end part 32 of the coil 30 toward the terminal 51. The cutout portion 43 is placed so as to face a side of the base 50 (an end of the base 50 in a short hand direction) where terminals 51 in plural are laid out in line.

Furthermore, the drum core 20 and the ring core 40 are made of magnetic materials; and as the magnetic materials, it is possible to use various kinds of ferrite, such as Ni-based ferrite, Mn-based ferrite, and so forth permalloy, sendust, and the like.

Figure 5:
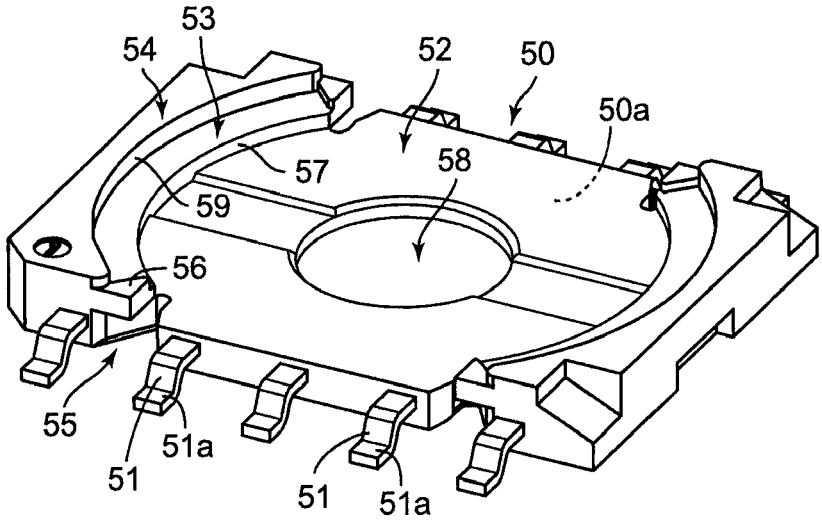
FIG. 5 is a perspective view showing a structure of a base of the magnetic element of FIG. 1.

In the meantime, the base 50 is made of a nonmagnetic material, such as a resin, and the like; while including a plurality of terminals 51 embedded in it. As shown in FIG. 5, each of the terminals 51 has a board connector 51*a* that protrudes downward further than a bottom surface 50*a* of the base 50. Then, at the time when the magnetic element 10 is mounted on a board, the board connector 51*a* makes contact with the board.

Figure 6:
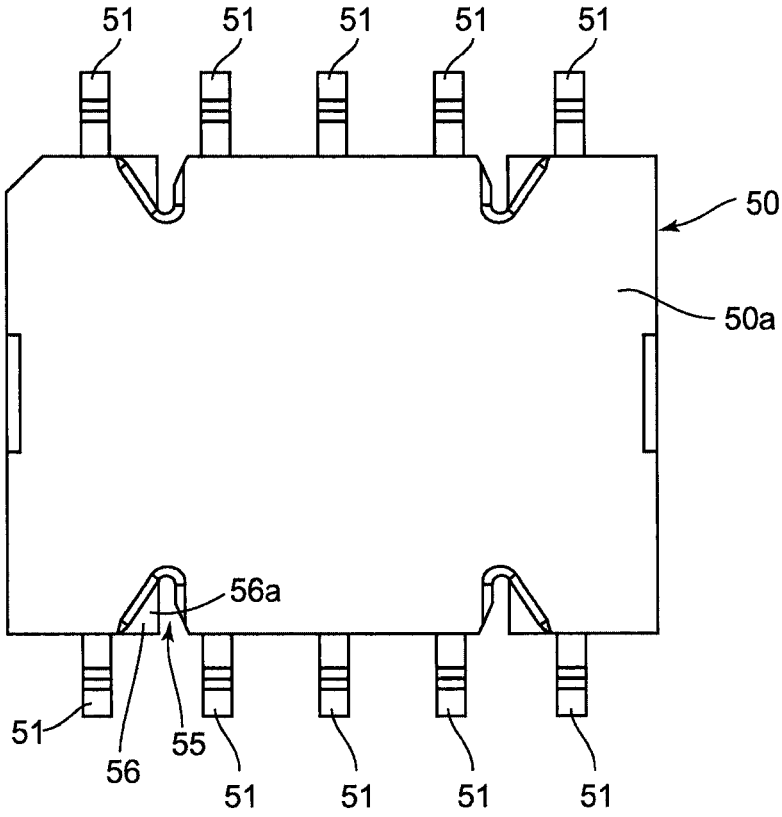
FIG. 6 is a bottom plan view showing the structure of the base of the magnetic element of FIG. 1.

As shown in FIG. 5, FIG. 6, and so on, the base 50 includes a drum mounting portion 52, a ring mounting portion 53, an outer circumference wall 54, the concave portion 55, and the protrusion 56 as other components of the embedded terminals 51. In all these components, the drum mounting portion 52 corresponds to a first mount portion, and it is a lowest height part in an upper surface side of the base 50, where the drum core 20 is placed. A first circumference wall 57, which is a boundary between the drum mounting portion 52 and the ring mounting portion 53, is provided so as to be almost circular in its overhead view. A distance in a radial direction from a center position of the drum mounting portion 52 to the first circumference wall 57 (i.e., corresponding to a radius) is provided so as to be slightly larger than a radius of the bottom surface 23*a* of the lower flange portion 23 of the drum core 20. In the present embodiment, the recessed portion 58 is placed at a center area of the drum mounting portion 52. Then, the locating protrusion 23*b* of the drum core 20 fits into the recessed portion 58 for locating the drum core 20 with respect to the base 50.

In the meantime, the ring mounting portion 53 corresponds to a second mount portion. The ring mounting portion 53 is positioned at an outer circumferential side of the drum mounting portion 52, being across the first circumference wall 57; and the ring mounting portion 53 is raised above the drum mounting portion 52 (i.e., positioned at a higher elevation). The ring mounting portion 53 is the part which the ring core 40 is placed. A second circumference wall 59, which is a boundary between the ring mounting portion 53 and the outer circumference wall 54, is provided so as to be almost circular in its overhead view in the same way as the first circumference wall 57 is. A dimension in a radial direction from the center position of the drum mounting portion 52 to the second circumference wall 59 is decided so as to be able to place a bottom surface 40*a* of the ring core 40 onto the ring mounting portion 53.

As FIG. 2 clearly shows, the ring mounting portion 53 is provided to be an arc in a state that both ends exist (with its length limited). Each of both the ends of the ring mounting portion 53 is provided with the concave portion 55 and the protrusion 56, to be described later.

As described above, being located at each of both the ends of the ring mounting portion 53, the concave portion 55 is provided so as to have a shape cutting out a part of the base 50 in the short hand direction of the base 50, as shown in FIG. 6. In the present embodiment, the concave portion 55 is located at each of both the ends of a pair of the ring mounting portion 53, shaped almost like a circle; accordingly there exist four concave portions 55 in total. Each concave portion 55 is a part where the coil end part 32 of the coil 30 is threaded through, as described later.

The concave portion 55 shown in FIG. 6 is provided to be shaped almost like a right triangle with its tip part rounded. Not limited to having such a shape, alternatively it is possible for the concave portions 55 to be adapted to any of other various shapes (for example, a polygonal shape such as a rectangular, or a circular form, and so on). Furthermore, the number of concave portions 55 is not limited to four, and any number of concave portions 55 may be placed as far as they are at least two concaves (the same can be said for the number of protrusions 56 as well, to be explained next).

Each of the protrusions 56 is provided in such a way as to cover over each of the concave portions 55. Protruding from an edge part of the ring mounting portion 53, the protrusion 56 is provided so as to hang over the concave portion 55. As shown in FIG. 5, the protrusion 56 is provided so as to have its bottom surface 56*a* located higher than a highest part of the terminals 51. Furthermore, the coil end part 32 of the coil 30 is positioned at the bottom surface 56*a* of the protrusion 56. Therefore, the protrusion 56 only may need to protrude over the concave portion 55 to a certain extent required for the coil end part 32 of the coil 30. In the present embodiment, the protrusion 56 protrudes in such a way as to cover approximately half of the 55, as shown in FIG. 6.

(Method of Mounting the Magnetic Element)

Explained below is a way of mounting the magnetic element 10 having a structure as described above. At first, the drum core 20 is placed on the drum mounting portion 52 of the base 50. At this time, the locating protrusion 23*b* fits into the recessed portion 58. An adhesive may be applied to the bottom surface 23*a* of the lower flange portion 23 before the drum core 20 is placed on the drum mounting portion 52.

Then, the lead wire 31 is wound on the bobbin 24 of the drum core 20, by making use of a wire-winding machine, or by hand work. Through the winding operation, the primary coil 30A and the secondary coil 30B are formed. Coil end part 32 of the primary coil 30A and the secondary coil 30B are left in a condition of being led out, after the winding operation.

Figure 7:
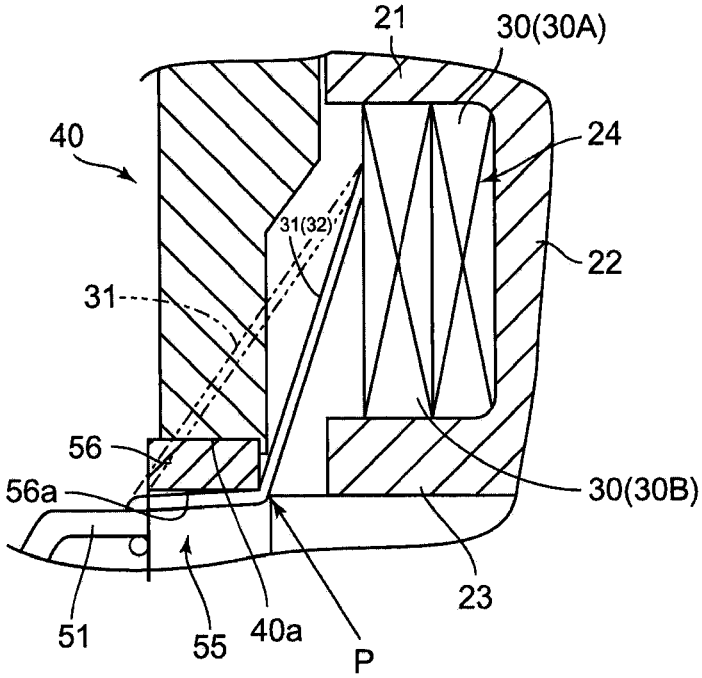
FIG. 7 shows positional relationships of a protrusion, a lead wire, a terminal, a ring core, and so forth in the magnetic element of FIG. 1.
Figure 8:
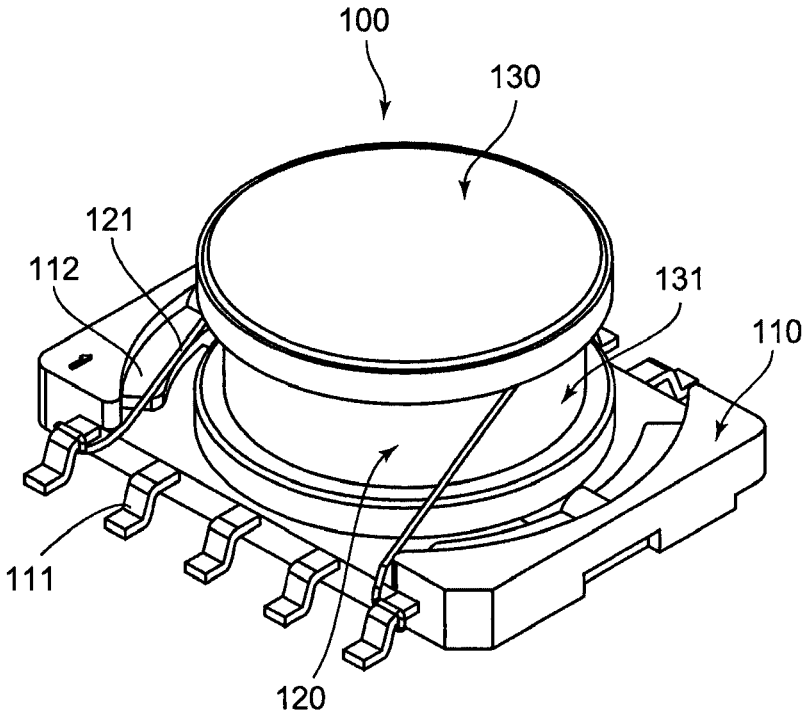
FIG. 8 is a perspective view showing a structure of a conventional type of drum core.

Then, a coil end part 32 of the coil 30 is led from the bobbin 24 through the clearance portion 44 in an obliquely downward direction so that the coil end part 32 is eventually led outside the ring core 40. In the meantime, the coil end part 32 is placed at the concave portion 55, and also placed at the bottom surface 56*a* of the protrusion 56. Thus, the coil end part 32 of the coil 30 reaches a terminal 51, and the coil end part 32 is wound on the terminal 51. Then, as shown in FIG. 7, the coil end part 32 of the lead wire 31 makes contact with the protrusion 56, and becomes curved there to form a bend P at the position. Furthermore, after winding the coil end part 32 on the terminal 51, the coil end part 32 and the terminal 51 may be fixed and stabilized through soldering while both the components being under a electrically-conducted condition.

Then, while the cutout portion 43 of the ring core 40 being oriented in a direction toward a side where the terminals 51 are lined up, the ring core 40 is placed on the ring mounting portion 53. Here, the bend P is formed in the coil end part 32 owing to presence of the protrusion 56, and at the same time the coil end part 32 is placed into the concave portion 55, as shown in FIG. 7. Therefore, a part of the lead wire 31 positioned to be closer toward the coil 30 than the bend P approaches a center side of the drum core 20 more (Refer to a solid-lined lead wire 31 and a double-dashed chain-lined lead wire 31 in FIG. 7). Thus, this prevents the ring core 40 and the lead wire 31 from interfering with each other. At the time of placement of the ring core 40, an adhesive may be applied to the bottom surface 40*a* of the ring core 40.

Effect of the Invention

In the magnetic element 10 having a structure as described above, the coil end part 32 of the coil 30 is placed at the concave portion 55, and then placed at the bottom surface 56*a* of the protrusion 56. Therefore, the coil end part 32 does not cross over the ring mounting portion 53. As a result, this makes it possible to keep the coil end part 32 of the coil 30 from becoming an obstacle at the time of placing the ring core 40 onto the ring mounting portion 53.

In other words, it is possible to prevent the coil end part 32 of the coil 30 from being pinched between the ring core 40 and the ring mounting portion 53 and therefore this makes it possible to prevent the ring core 40 from becoming tilted, unstable, and so on. As a result, the ring core can precisely be positioned. Furthermore, since it is possible to prevent the coil end part 32 from being positioned on the ring mounting portion 53, installation of the ring core 40 onto the ring mounting portion 53 can be carried out easily, and therefore an increase in working man-hours can be suppressed.

Moreover, in the present invention, the coil end part 32 of the coil 30 is placed into the concave portion 55. Therefore, in comparison with a case where the concave portion 55 is not provided, the bend P of the coil end part 32 can be so positioned as to be closer toward the center side of the drum core 20 in a radial direction. Accordingly, the part of the lead wire 31 positioned to be closer toward the coil 30 than the bend P approaches the center side of the drum core 20 more. Thus, this makes it possible to prevent the ring core 40 and the lead wire 31 from interfering with each other, and eventually it becomes possible effectively to preclude the ring core 40 and the lead wire 31 from interfering with each other (i.e., the coil end part 32 becomes an obstacle for placement of the ring core 40).

Furthermore, in the present invention, the drum core 20 includes the locating protrusion 23*b* protruding in a direction to a side of the base 50, while the base 50 includes the recessed portion 58 into which the locating protrusion 23*b* fits. Therefore, as the locating protrusion 23*b* fits into the recessed portion 58, the drum core 20 is precisely positioned with respect to the base 50. As a result, the magnetic element 10 is able to have stable characteristics.

Moreover, in the present invention, the clearance portion 44 is formed in the ring core 40. Accordingly, the coil end part 32 of the coil 30 can be easily led into the concave portion 55 through the clearance portion 44 from the bobbin 24. Therefore, the coil end part 32 of the coil 30 can easily be wound on the terminal 51 in a state of being positioned with the protrusion 56 at the concave portion 55.

Modifications

Explained above is the magnetic element 10 according to the embodiment of the present invention; and besides the embodiment, various other modifications may be made in relation to the present invention, as described below.

In the embodiment described above, the drum core 20 is used as the first core member, while the ring core 40 is used as the second core member. However, the first core member is not limited to the drum core 20, and neither is the second core member limited to the ring core 40. For example, a T-shaped core may be used as the first core member, while a pot-shaped core may be used as the second core member.

Moreover, in the embodiment described above, the upper flange portion 21 and the lower flange portion 23 of the drum core 20 have their diameters that are almost the same. However, for example, the upper flange portion may be so formed as to have a larger diameter than the lower flange portion has; and contrarily the upper flange portion may be so formed as to have a smaller diameter than the lower flange portion has. Furthermore, a drum type core may be formed by combining a T-shaped core with a disc-shaped core, in place of the drum core.

Moreover, in the embodiment, the drum core 20 and the ring core 40 are provided to be circular in their overhead views. However, shapes of the drum core and the ring core are not limited to circular shapes in their overhead views, and these core components may be formed in various other shapes including polygonal shapes, such as a box shape, a hexagonal shape, an octagonal shape, and the like as well as an oval shape and so on.

Furthermore, in the embodiment, the ring mounting portion 53 is formed to be flat. However, applied may be another structure, in which the ring mounting portion 53 includes a protrusion protruding upward, while a groove or the like, into which the protrusion fits, is formed at the bottom surface of the ring core 40 so that the ring core 40 is positioned with respect to the base 50 by fitting the protrusion into the groove or the like.

Moreover, in the embodiment described above, the explanation is made about a transformer as the magnetic element to which the present invention is applied. However, the magnetic element is not limited to such a transformer, and the present invention may be applied to any magnetic element other than a transformer (an inductor, a choke coil, a filter, and so on).

Furthermore, an application of the magnetic element 10 of the embodiment described above is not limited to any specific purpose, and the magnetic element can be used for various applications.

INDUSTRIAL APPLICABILITY

The magnetic element according to the present invention can be applied in fields of electric appliances.

REFERENCE NUMERALS

10. Magnetic element
20. Drum core (corresponding to the first core member)
21. Upper flange portion
22. Column portion
23. Lower flange portion
23*b*. Locating protrusion
30. Coil
31. Lead wire
32. Coil end part
40. Ring core (corresponding to the second core member)
41. Open portion
42. Core part
44. Clearance portion
50. Base
51. Terminal
52. Drum mounting portion (corresponding to the first mount portion)
53. Ring mounting portion (corresponding to the second mount portion)
54. Outer circumference wall
55. Concave portion
56. Protrusion
58. Recessed portion

What is claimed is:

1. A magnetic element comprising:

a first core member having a bobbin;

a second core member so placed as to face the first core member in a whole range around an outer circumference of the first core member;

a coil placed by winding a lead wire and placed at the bobbin; and a base having a first mount portion for placing the first core member, a second mount portion for placing the second core member and being raised higher than the first mount portion and positioned between both end portions, and a plurality of terminals protruding from a side of the base;

wherein the end portion of the second mount portion has a protrusion lengthening in a direction apart from the second mount portion, and the protrusion is sized smaller than the thickness of the base; and a coil end part of the coil is wound on the terminal after the coil end part of the coil is placed at a reverse surface of the protrusion opposite to a side for placing the second core member;

wherein the end of the second mount portion in the base has a concave portion recessed in a direction toward the opposite side of the base from one side of the base;

the end of the coil is inserted into the concave portion at the side opposite to the one side of the concave portion then the one side of the concave portion, and the protrusion is provided in a state of covering over the concave portion from the side for placing the second core member.

2. The magnetic element according to claim 1:

wherein the first core member is provided with a locating protrusion protruding in a direction toward a side of the base, while the first mount portion of the base is provided with a recessed portion into which the locating protrusion fits.

3. The magnetic element according to claim 1:

wherein the second core member has a clearance portion where an inner diameter of an open portion of the second core member at a lower side for placing the second core member onto the second mount portion is formed to be larger in comparison with an inner diameter of the open portion at an upper side.

* * * * *